US009466882B2

(12) United States Patent
Yamada et al.

(10) Patent No.: US 9,466,882 B2
(45) Date of Patent: Oct. 11, 2016

(54) ANTENNA MAGNETIC CORE, ANTENNA USING SAME, AND DETECTION SYSTEM

(71) Applicants: KABUSHIKI KAISHA TOSHIBA, Tokyo (JP); TOSHIBA MATERIALS CO., LTD., Yokohama-shi, Kanagawa (JP)

(72) Inventors: Katsuhiko Yamada, Yokohama (JP); Tadao Saito, Yokohama (JP)

(73) Assignees: KABUSHIKI KAISHA TOSHIBA, Tokyo (JP); TOSHIBA MATERIALS CO., LTD., Yokohama-Shi (JP)

( * ) Notice: Subject to any disclaimer, the term of this patent is extended or adjusted under 35 U.S.C. 154(b) by 106 days.

(21) Appl. No.: 14/449,578

(22) Filed: Aug. 1, 2014

(65) Prior Publication Data

US 2015/0022410 A1 Jan. 22, 2015

Related U.S. Application Data

(63) Continuation of application No. PCT/JP2013/000569, filed on Feb. 1, 2013.

(30) Foreign Application Priority Data

Feb. 3, 2012 (JP) ..... 2012-022315

(51) Int. Cl.

| | |
|---|---|
| ***H01Q 7/08*** | (2006.01) |
| ***H01F 27/25*** | (2006.01) |
| ***H01Q 7/06*** | (2006.01) |
| ***H01F 1/153*** | (2006.01) |
| ***H01F 3/04*** | (2006.01) |
| ***H01F 10/26*** | (2006.01) |
| ***C22C 32/00*** | (2006.01) |
| *H01Q 1/32* | (2006.01) |

(52) U.S. Cl.

CPC ..... *H01Q 7/08* (2013.01); *C22C 32/0094* (2013.01); *H01F 1/15316* (2013.01); *H01F 3/04* (2013.01); *H01F 10/265* (2013.01); *H01F 27/25* (2013.01); *H01Q 7/06* (2013.01); *C22C 2202/02* (2013.01); *H01Q 1/3241* (2013.01)

(58) Field of Classification Search

CPC ..... H01Q 7/08; H01F 27/25
USPC ..... 343/788
See application file for complete search history.

(56) References Cited

U.S. PATENT DOCUMENTS

| | | | | |
|---|---|---|---|---|
| 5,567,537 | A | 10/1996 | Yoshizawa et al. | |
| 7,504,924 | B2 | 3/2009 | Inoue et al. | |
| 2007/0040643 | A1* | 2/2007 | Inoue | H01F 17/045 336/213 |
| 2011/0248819 | A1 | 10/2011 | Saito et al. | |

FOREIGN PATENT DOCUMENTS

| | | | |
|---|---|---|---|
| JP | 07-278763 | A | 10/1995 |
| JP | 2002-288613 | A | 10/2002 |
| JP | 2009-194724 | A | 8/2009 |
| JP | 2011-014919 | A | 1/2011 |
| WO | WO 2010/073577 | A1 | 7/2010 |

* cited by examiner

*Primary Examiner* — Dameon E Levi
*Assistant Examiner* — Andrea Lindgren Baltzell
(74) *Attorney, Agent, or Firm* — Foley & Lardner LLP

(57) ABSTRACT

An antenna magnetic core of an embodiment has a laminate of a Co-based amorphous magnetic alloy thin strip and a resin layer part having an average thickness in a range of from 1 to 10 μm. Dispersion of thicknesses of the resin layer part is within ±40% in relation to the average thickness.

13 Claims, 4 Drawing Sheets

ANTENNA MAGNETIC CORE, ANTENNA USING SAME, AND DETECTION SYSTEM

CROSS-REFERENCE TO RELATED APPLICATIONS

This application is a continuation of prior International Application No. PCT/JP2013/000569 filed on Feb. 1, 2013, which is based upon and claims the benefit of priority from Japanese Patent Application No. 2012-022315 filed on Feb. 3, 2012; the entire contents of all of which are incorporated herein by reference.

FIELD

Embodiments described herein relate generally to an antenna magnetic core, and an antenna and a detection system using the same.

BACKGROUND ART

As an antenna, one made by winding a coil (a winding) around an antenna magnetic core is known. The antenna magnetic core has a structure in which a plurality of magnetic thin strips is laminated via a resin layer part, for example. For the magnetic thin strip of the antenna magnetic core, a Co-based amorphous magnetic alloy thin strip or the like is used. A plurality of Co-based amorphous magnetic alloy thin strips is laminated via an adhesive layer (a resin layer part). In order to improve a property as the antenna, there is suggested an antenna magnetic core made by providing a line-shaped mark on a surface of a Co-based amorphous magnetic alloy thin strip and laminating the Co-based amorphous magnetic alloy thin strips with directions of the line-shaped marks being aligned. In an antenna using such an antenna magnetic core, there is a case where the property as the antenna is reduced even though the antenna is fabricated by winding a coil around the antenna magnetic core with no defects in appearance.

There are various factors of reduction in the antenna property as stated above, and as one of the factors, a defect of the resin layer part formed between the magnetic alloy thin strips is conceivable. Conventionally, in forming a resin layer part, there are applied a method of immersing a laminate of magnetic alloy thin strips in a resin liquid, a method of immersing a long-length magnetic alloy thin strip in a resin liquid in the middle of reeling, to form a laminate, and so on. It is conceivable that a defect occurs in the resin layer part due to such a forming method, reducing the property of the antenna. For example, there is a case where an L value or a Q value of an antenna fabricated by winding an antenna magnetic core with no problem in appearance is reduced. A defect of a resin layer part of an antenna magnetic core cannot be judged from appearance, and is a cause to reduce reliability of an antenna.

SUMMARY

A problem to be solved by the present invention is to provide an antenna magnetic core which eliminates a defect of a resin layer part difficult to be judged from appearance and which enables improving an antenna property reproducibly, and further to provide an antenna and a detection system improved in properties and reliability by using such an antenna magnetic core.

An antenna magnetic core of an embodiment has a laminate of Co-based amorphous magnetic alloy thin strips and a resin layer part having an average thickness in a range of 1 μm or more to 10 μm or less. Dispersion of thicknesses of the resin layer part is within ±40% in relation to the average thickness.

An antenna of the embodiment has an antenna magnetic core of the embodiment and a winding wound around an outer periphery of the antenna magnetic core. A detection system of the embodiment has a transmitter transmitting a specific radio signal and a receiver receiving the radio signal and detecting the transmitter. The receiver has an antenna of the embodiment as a receiving antenna of the radio signal.

DETAILED DESCRIPTION

Hereinafter, an antenna magnetic core of an embodiment, and an antenna and a detection system using the same will be described. The antenna magnetic core of the embodiment has a laminate of Co-based amorphous magnetic alloy thin strips and a resin layer part. In the antenna magnetic core of the embodiment, the resin layer part has an average thickness in a range of 1 to 10 μm. Dispersion of thicknesses of the resin layer part is within ±40% in relation to the average thickness.

Figure 1:
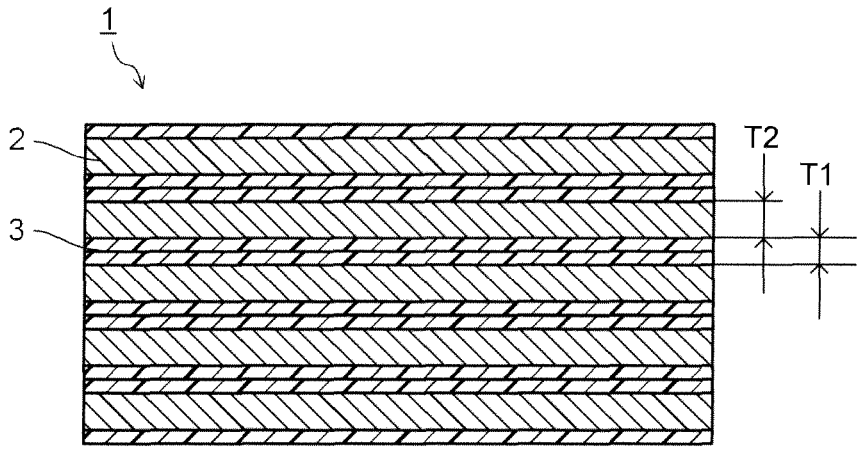
FIG. 1 is a cross-sectional view showing an antenna magnetic core of an embodiment.

FIG. 1 is a cross-sectional view showing the antenna magnetic core of the embodiment. In FIG. 1, a reference numeral 1 indicates the antenna magnetic core, a reference numeral 2 indicates the Co-based amorphous magnetic alloy thin strip, a reference numeral 3 indicates the resin layer part, a reference numeral T1 indicates the average thickness of the resin layer part 3, and a reference numeral T2 indicates an average thickness of the Co-based amorphous magnetic alloy thin strip 2. The antenna magnetic core 1 of the embodiment has a laminated structure in which a plurality of Co-based amorphous magnetic alloy thin strips 2 and resin layer parts 3 are laminated alternately. The average thickness (T1) of the resin layer part 3 is in the range of 1 to 10 μm. When the average thickness of the resin layer part 3 is less than 1 μm, a gap (a portion without a resin) is apt to occur in the resin layer part 3 and an insulation performance between the neighboring Co-based amorphous magnetic alloy thin strips 2 is hard to be secured. When the average thickness of the resin layer part 3 is over 10 μm, a thickness of the antenna magnetic core 1 becomes unnecessarily thick.

The average thickness of the resin layer part is obtained as below. Thicknesses of arbitrary ten places in one resin layer part (the resin layer part constituting one layer) 3 are measured, and an average value thereof is regarded as the average thickness (T1) of the resin layer part 3. In the resin layer part 3 of the embodiment, dispersion of thicknesses of the entire resin layer part 3 in relation to the average thickness (T1) is in a range of ±40%. When the dispersion of thicknesses of the resin layer part 3 is smaller than −40% or larger than +40%, a portion (a gap portion) where a resin does not exist is generated in the resin layer part 3, and an insulation performance between the Co-based amorphous magnetic alloy thin strips 2 is reduced. Further, there is a possibility that a local convex part is generated in the Co-based amorphous alloy thin strip 2, so that an unnecessary stress is applied to the Co-based amorphous alloy thin strip 3 at a time of lamination.

The dispersion of the thicknesses of the resin layer part 3 being within ±40% means that the thickness of any place of the resin layer part 3 is in a range of 60 to 140% when the average thickness (T1) is 100%. For example, when the average thickness T1 of the resin layer part 3 is 3 μm, the thickness of the resin layer part 3 is, in any place, in a range of 1.8 to 4.2 μm. The dispersion of the thicknesses of the resin layer part 3 is preferable to be within ±30%, and is more preferable to be within ±20%. By reducing the thickness of the resin layer part and the dispersion thereof, an L value and a Q value of an antenna are improved, and it is possible to prevent occurrence of a defect which cannot be judged from appearance.

A thickness of the Co-based amorphous magnetic alloy thin strip 2 is preferable to be in a range of 10 to 30 μm. The thickness of the Co-based amorphous magnetic alloy thin strip 2 is represented by an average thickness (T2) obtained by a weighing method. By the weighing method, the thickness is obtained by using a relation of "mass/volume=density" of the Co-based amorphous magnetic alloy thin strip 2. Concretely, a density (an actual measured value) of the Co-based amorphous magnetic alloy thin strip 2 is obtained by an Archimedes method. Next, a length (a long edge) and a width (a short edge) of the Co-based amorphous magnetic alloy thin strip 2 are measured with a caliper or the like. A mass of the Co-based amorphous magnetic alloy thin strip 2 is measured. The average thickness T2 of the Co-based amorphous magnetic alloy thin strip 2 is obtained from a relation of mass/(length×width×thickness)=density. In other words, the average thickness T2 of the Co-based amorphous magnetic alloy thin strip 2 can be obtained from "mass/density (actual measured value)× length×width".

The Co-based amorphous magnetic alloy thin strip 2 is fabricated by a roll rapid cooling method such as a single roll method or a twin roll method. The roll rapid cooling method is a method of spraying a molten metal to be a material of an amorphous alloy onto a chill roll rotating at a high speed, to obtain a long-length amorphous magnetic alloy thin strip. Since the chill roll is used, microscopic surface projection and depression to cause a line-shaped mark are formed on a surface of the obtained amorphous magnetic alloy thin strip. It is difficult to fabricate a Co-based amorphous magnetic alloy thin strip 2 with a thickness of less than 10 μm by the roll rapid cooling method. When the thickness of the Co-based amorphous magnetic alloy thin strip 2 is over 30 μm, the surface projection and depression become too large, so that it becomes difficult to control dispersion of thicknesses of a resin layer part 3 provided between the Co-based amorphous magnetic alloy thin strips 2 in a range of ±40%.

The resin layer part 3 is preferable to be a solid body of a semi-cured resin. The semi-cured resin is a resin which is solid at a room temperature and is melted when heated. The semi-cured resin is preferable to have a thermosetting property of being solidified when being continually heated at a high temperature. As the semi-cured resin, various resins such as an epoxy-based resin, a urethane-based resin, and a silicone-based resin are known. The semi-cured resin can be obtained by applying a composition capable of halting a cross-linking reaction (a polymerization reaction) in a partial state, to grant a semi-curing property, for example.

When the semi-cured resin is used, by once heating and melting the resin to provide a resin layer on a surface of the Co-based amorphous magnetic alloy thin strip 2, and thereafter keeping at a room temperature, the resin layer is solidified on the surface of the Co-based amorphous magnetic alloy thin strip 2. Since the resin layer after solidification has adhesiveness, a shape is maintained on the surface of the Co-based amorphous magnetic alloy thin strip 2. Thus, even when the resin layer parts 3 are formed on both surfaces of the Co-based amorphous magnetic alloy thin strip 2, the resin does not run down. By using such a phenomenon, it is possible to fabricate an antenna magnetic core 1 by applying a method of laminating the Co-based amorphous magnetic alloy thin strips 2 provided with the resin layers on both surfaces as described later. By laminating the Co-based amorphous magnetic alloy thin strips 2 having the resin layers formed on both surfaces thereof in advance, a thickness of the entire of the resin layer part 3 can be uniformized. Further, occurrence of a gap (a part without a resin) in the resin layer part 3 can be suppressed effectively.

Among conventional forming methods of a resin layer part, the method of immersing a laminate of amorphous magnetic alloy thin strips in a resin liquid is a method in which the resin liquid is made to penetrate from an end part of the laminate, and thus, the resin liquid does not reach a center part in a long-length or wide amorphous magnetic alloy thin strip, so that a gap where a resin does not exist is apt to be formed in a neighborhood of a center of a resin layer part of an antenna magnetic core. By the method of immersing the long-length amorphous magnetic alloy thin strip in the resin liquid in the middle of reeling, it is difficult to form resin layers uniformly on front and rear surfaces of the amorphous magnetic alloy thin strip. Therefore, when an antenna magnetic core is fabricated by laminating a plurality of amorphous magnetic alloy thin strips, dispersion of thicknesses of a resin layer part becomes large. When the gap (the part without the resin) occurs in the resin layer part or when the comparatively large dispersion exists in thicknesses of the resin layer part, an L value or a Q value is reduced when a winding is applied and the antenna magnetic core is made into an antenna, though the antenna magnetic core does not have a problem in appearance.

In the antenna magnetic core 1 of the embodiment, by making the dispersion of thicknesses of the resin layer part 3 within ±40% in relation to the average thickness, reduction of the antenna property due to occurrence of the gap in the resin layer part 3 or the thickness dispersion is suppressed. According to an antenna fabricated by applying a winding to the antenna magnetic core 1 of the embodiment, it is possible to heighten an L value and a Q value reproducibly. Further, it is possible to prevent occurrence of a defect which cannot be judged from an appearance of the antenna magnetic core 1, and further, reduction of a property and reliability of the antenna based thereon.

Figure 2:
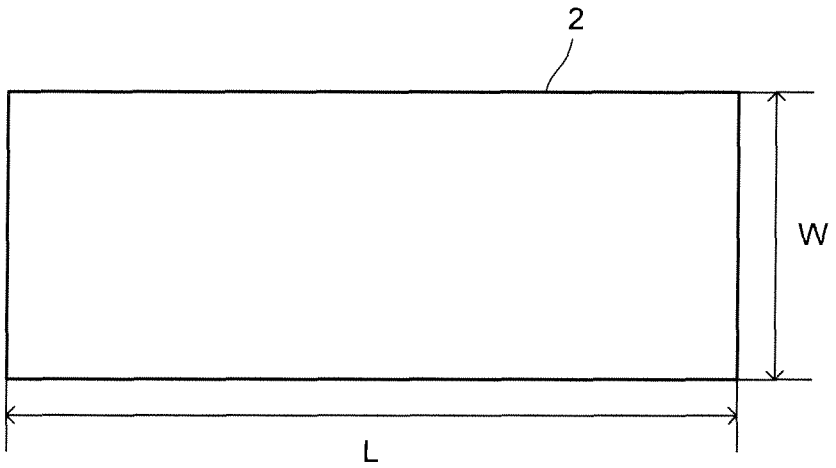
FIG. 2 is a plan view of a Co-based amorphous magnetic alloy thin strip used for the antenna magnetic core of the embodiment.

The Co-based amorphous magnetic alloy thin strip 2 is preferable to have a rectangular shape satisfying at least one of a short edge being 1 mm or more and a long edge being 10 mm or more. FIG. 2 is a plan view of the Co-based amorphous magnetic alloy thin strip 2 used in the embodiment. In FIG. 2, a reference symbol W indicates the short edge of the Co-based amorphous magnetic alloy thin strip 2, and a reference symbol L indicates the long edge of the Co-based amorphous magnetic alloy thin strip 2. The short edge W is preferable to be 1 mm or more, and is more preferable to be 1 to 5 mm. The long edge L is preferable to be 10 mm or more, and is more preferable to be 12 to 30 mm. A ratio (L/W) of the long edge L in relation to the short edge W is preferable to be 2 or more. By making the L/W ratio be 2 or more, an antenna property can be improved.

It is preferable that 10 or more Co-based amorphous magnetic alloy thin strips 2 are laminated. A lamination number of the Co-based amorphous magnetic alloy thin strips 2 is not limited in a range of realizing an object antenna property. When the antenna magnetic core 1 and the antenna using the same are used for a vehicle keyless entry system described later, the lamination number of the Co-based amorphous magnetic alloy thin strips 2 is preferable to be 10 to 50. When the lamination number of the Co-based amorphous magnetic alloy thin strips 2 is less than 10, there is a possibility that an object antenna property (the L value or the Q value) cannot be obtained. Further, when the lamination number is less than 10, a strength as the antenna magnetic core 1 is reduced, and there is also a possibility that the antenna magnetic core 1 is damaged in a winding step. When the lamination number of the Co-based amorphous magnetic alloy thin strips 2 is over 50, the antenna property itself is improved, but the antenna magnetic core 1 becomes unnecessarily large, reducing practicality in various usages.

When ten or more Co-based amorphous magnetic alloy thin strips 2 are to be laminated, it is preferable that a resin layer part 3 whose average thickness is 1 to 10 μm and dispersion of whose thicknesses is within ±40% in relation to the average thickness is provided between the laminated Co-based amorphous magnetic alloy thin strips 2. This means that the average thickness of all the resin layer parts 3 is 1 to 10 μm and that the dispersion of thicknesses is within ±40% in relation to the average thickness. The dispersion of thicknesses of the resin layer part 3 is more preferable to be within ±30% in relation to the average thickness, and is further preferable to be within ±20%. By controlling the average thicknesses of all the resin layer parts 3 and the dispersion thereof, occurrence of the gap in the resin layer part 3 can be prevented. Further, by reducing the dispersion of thicknesses, that is, by uniformizing the thicknesses of the resin layer parts 3, distortion of the antenna magnetic core 1 can be reduced.

A composition of the Co-based amorphous magnetic alloy thin strip 2 is not limited in particular. To improve properties of the antenna magnetic core 1 and the antenna using the antenna magnetic core 1, the Co-based amorphous magnetic alloy thin strip 2 is preferable to have the following composition.

General formula: $Co_aD_bM_cSi_dB_e$ (1)

(In the formula, "D" indicates at least one element selected from Fe and Ni, "M" indicates at least one element selected from Ti, V, Cr, Mn, Cu, Zr, Nb, Mo, Ta, and W, and "a", "b", "c", "d", and "e" satisfy a+b+c+d+e=100 atomic %, $1 \le b \le 10$, $0.3 \le c \le 6$, $5 \le d \le 12$, and $1 \le e \le 8$.)

The element D is an element effective for improvement of a magnetic property such as a maximum magnetic flux density. Further, by adding the element D, a mechanical strength of the Co-based amorphous magnetic alloy thin strip 2 is also improved. In view of the above, a content of the element D is preferable to be in a range of 1 to 10 atomic %. When the content of the element D is over 10 atomic %, a content of Co is decreased correlatively, and thus there is a possibility that the property of the Co-based amorphous magnetic alloy thin strip 2 is damaged. The element M is an element effective for improvement of a corrosion resistance, and so on, and a content thereof is preferable to be in a range of 0.3 to 6 atomic %. Si and B are elements to promote amorphization, and a content of Si is preferable to be in a range of 5 to 12 atomic % and a content of B is preferable to be in a range of 1 to 8 atomic %. Since the Co-based amorphous alloy having the composition represented by the formula (1) has a magnetostriction of almost zero (1 ppm or less in an absolute value), it is possible to suppress deterioration of the property of the antenna magnetic core 1 even in a case where the resin layer parts 3 are formed between all the Co-based amorphous magnetic alloy thin strips 2.

Next, a method for manufacturing an antenna magnetic core of the embodiment will be described. The antenna magnetic core of the embodiment is not limited in terms of a manufacturing method, as long as the antenna magnetic core has a configuration described above. As a method for manufacturing the antenna magnetic core of the embodiment at a high yield, a manufacturing method described below can be cited.

A long-length Co-based amorphous magnetic alloy thin strip is fabricated by a roll rapid cooling method. A Co-based amorphous alloy is preferable to have the composition represented by the aforementioned formula (1). In fabricating the long-length alloy thin strip by the roll rapid cooling method, material powders of Co and the like are blended to have a predetermined composition, and melted to be molten metal. The molten metal is injected to a cooling roll which is rotating at a high speed and rapid cooling of $10^4$ to $10^{6}$° C./sec is performed, so that the long-length Co-based amorphous magnetic alloy thin strip is obtained.

A degree of long length is arbitrary, but is preferable to be 2 to 15 km, when a mass productivity is considered. When the degree of the long length is less than 2 km, a thin strip amount obtained at one time is small, and such a degree is unsuitable for mass production. When the degree of the long length is over 15 km, winding around a spool is troublesome and the spool after winding becomes too heavy, and workability is bad. A heat-resistant roll for injection for a thin strip of 15 km or more becomes necessary. A thickness and a width of the Co-based amorphous magnetic alloy thin strip can be adjusted by a shape of a nozzle, an injection pressure, or the like at a time of injection of the molten metal.

Next, the obtained long-length Co-based amorphous magnetic alloy thin strip is cut into a predetermined size. The Co-based amorphous magnetic alloy thin strip after cutting can be one which is processed to a size of the Co-based amorphous magnetic alloy thin strip 2 being a final product, or can be a medium-length Co-based amorphous magnetic alloy thin strip having a size equivalent to a plurality of (for example, equivalent to 2 to 5) final products.

Figure 3:
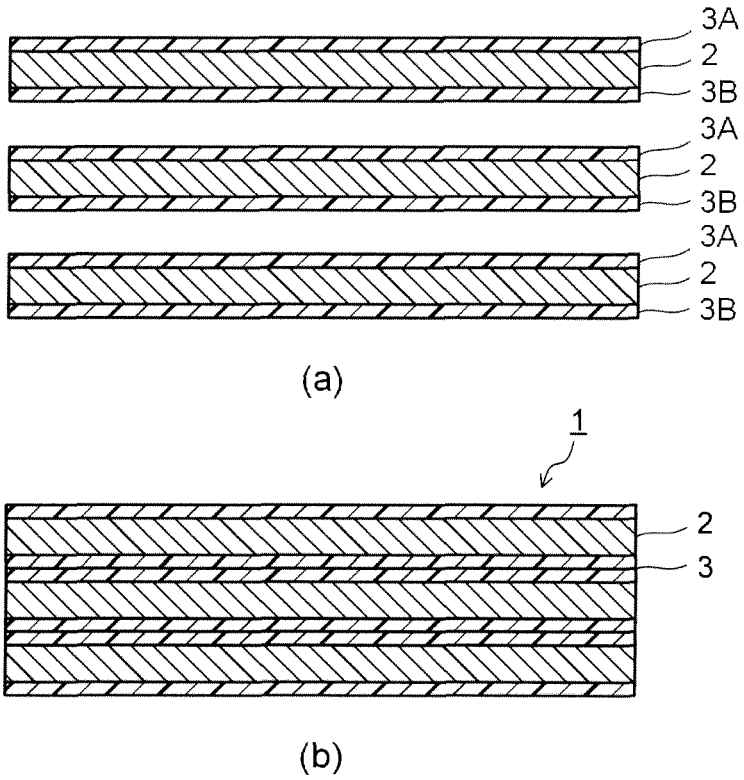
FIG. 3 is a cross-sectional view showing a manufacturing step of the antenna magnetic core of the embodiment.

As shown in FIG. 3(*a*), a resin is applied to both surfaces of the Co-based amorphous magnetic alloy thin strip 2 after cutting, to form resin layers 3A, 3B. On this occasion, it is preferable to use a semi-cured resin. As a result that the semi-cured resin is kept at a room temperature after being applied to both surfaces of the Co-based amorphous magnetic alloy thin strip 2, the resin layers 3A, 3B come into a solid state. Therefore, the resin layer 3B provided on the rear surface of the Co-based amorphous magnetic alloy thin strip 2 does not run down. It is possible to perform the following laminating step in a state where the resin layers 3A, 3B are provided on both surfaces of the Co-based amorphous magnetic alloy thin strip 2.

As shown in FIG. 3(*b*), the Co-based amorphous magnetic alloy thin strips 2 provided with the resin layers 3A, 3B on both surfaces are laminated. A necessary number of Co-based amorphous magnetic alloy thin strips 2 are laminated to form a laminate. Air existing in a gap between the resin layers 3A, 3B is removed by being pressed, as necessary. Next, after heating is performed to a temperature at which the semi-cured resin is melted to melt the resin layers 3A, 3B, the resin layers 3A, 3B are solidified integrally. Since the resin layers 3A, 3B are solidified again after being once melted after lamination of the Co-based amorphous magnetic alloy thin strips 2, a thickness of the resin layer part 3 can be made uniform. By performing a melting step, the molten resin gets into every corner of microscopic surface projection and depression of the Co-based amorphous magnetic alloy thin strip 2, and dispersion of thicknesses of the resin layer part 3 can be reduced. By such work, an antenna magnetic core 1 is fabricated.

In the laminating step, it is preferable to perform a heat treatment in order to finally solidify (cure) the resin layers 3A, 3B. It is preferable to perform the heat treatment for curing the resin layers 3A, 3B at a temperature of 220° C. or lower. When the Co-based amorphous magnetic alloy thin strip 2 is heat-treated at quite a high temperature, there is a possibility that crystallization is promoted, reducing a magnetic property. Thus, it is preferable to use a semi-cured resin which is cured at the temperature of 220° C. or lower. However, when a heat treatment temperature is quite low, progress of curing becomes slow, so that a manufacturing time becomes unnecessarily long. The heat treatment temperature at which the semi-cured resin is cured is preferable to be 120 to 220° C., and is more preferable to be 150 to 210° C. When the Co-based amorphous magnetic alloy thin strip 2 having the composition represented by the aforementioned formula (1) is used, the heat treatment temperature is preferable to be 150 to 210° C. If the heat treatment temperature is in the above range, it is possible to obtain an effect equivalent to that of a heat treatment for improving a magnetic property described later.

It is preferable that a cutting process is applied to at least one outer edge of the Co-based amorphous magnetic alloy thin strip 2. When a role rapid cooling method is applied to fabrication of a Co-based amorphous magnetic alloy thin strip 2, a long-length Co-based amorphous magnetic alloy thin strip is fabricated as described above. In order to improve a mass productivity, a long-length or medium-length Co-based amorphous magnetic alloy thin strip longer than a Co-based amorphous magnetic alloy thin strip 2 constituting a final antenna magnetic core is fabricated, and resin layers are provided on both surfaces thereof. After a necessary number of long-length or medium-length Co-based amorphous magnetic alloy thin strips as above are laminated, the resin layers are solidified, to fabricate a long-length or medium-length laminate. By cutting the laminate into a size of an antenna magnetic core 1 being a final product, a plurality of antenna magnetic cores can be obtained simultaneously. A manufacturing step of the antenna magnetic core 1 is preferable to be a multiple piece forming step as above. It is a matter of course that a method is also effective in which after cutting into a Co-based amorphous magnetic alloy thin strip 2 constituting an antenna magnetic core 1 being a final product, resin layers are formed on both surfaces thereof and laminating and integration are performed.

Figure 4:
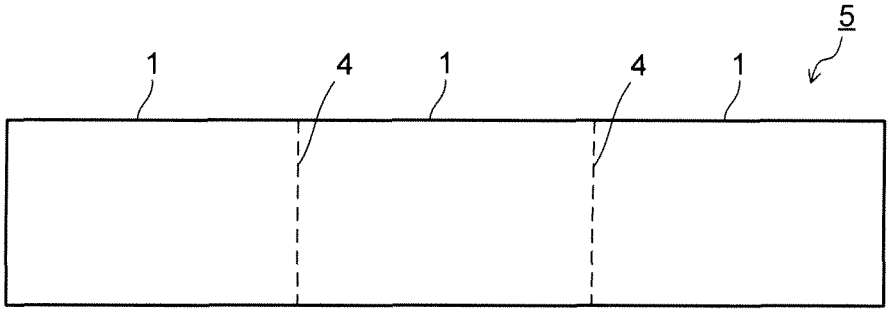
FIG. 4 is a plan view showing another manufacturing step of the antenna magnetic core of the embodiment.

FIG. 4 shows a manufacturing step of the antenna magnetic core 1 to which a multiple piece forming step is applied. In FIG. 4, a reference numeral 1 indicates an antenna magnetic core, a reference numeral 4 indicates a cutting place, and a reference numeral 5 indicates a laminate made by laminating a medium-length Co-based amorphous magnetic alloy thin strip having a length equivalent to three pieces. As a result that the laminate 5 of the medium-length Co-based amorphous magnetic alloy thin strips is cut along cutting places 4, three pieces of antenna magnetic core 1 can be obtained. In other words, forming of multiple pieces of the antenna magnetic core 1 from the laminate 5 of the medium-length Co-based amorphous magnetic alloy thin strips 5 is possible. The antenna magnetic core 1 of the embodiment, having the resin layer parts 3 in which dispersion of thicknesses is reduced, can maintain uniformity of the thicknesses of the resin layer parts 3 even when a cutting stress is applied. Since the resin layer part 3 formed by solidifying a semi-cured resin has proper hardness and flexibility, it is possible to make a height of a projecting part formed in an outer edge having been cut-processed of the Co-based amorphous magnetic alloy thin strip 2 as small as 2 μm or less, and further 0.5 μm (including zero) or less. The projecting part formed in the outer edge having been cut-processed is a projection such as a burr. When the projecting part contacts another magnetic thin strip of the laminate, an insulation performance is damaged and an antenna property is reduced.

It is possible to apply a heat treatment or a bending process to the antenna magnetic core 1, as necessary. The heat treatment to the antenna magnetic core 1 is performed separately from the heat treatment for solidification processing of the resin layer part 3, and is performed for improvement of a magnetic property. A condition of the heat treatment is preferable to be 120 to 320° C.×0.5 to 3 hours. The heat treatment can be performed in a magnetic field of 160 A/m or more, preferably 800 A/m or more, as necessary. The heat treatment can be applied to the Co-based amorphous magnetic alloy thin strip 2 before lamination. The bending process can be performed before the Co-based amorphous magnetic alloy thin strips 2 are laminated, or can be performed after the antenna magnetic core 1 is fabricated. The bending process is effective when an antenna is required to be bent due to a small mounting space, in mounting the antenna in a detection system. The Co-based amorphous magnetic alloy thin strip 2, having a high strength, is not damaged even if a two-fold bending process is performed, for example, as the bending process. Since it is easy to make the Co-based amorphous magnetic alloy thin strip 2 cope with shape change by the bending process, the antenna can be mounted in a curved space.

Next, an antenna of the embodiment will be described. The antenna of the embodiment has the antenna magnetic core 1 of the embodiment described above and a winding wound around an outer periphery of the antenna magnetic core 1. The winding is preferable to be an insulator-coated conductor with a wire diameter of 0.03 to 1 mm. The wire diameter is a wire diameter of a conductor portion. When the wire diameter of the winding is less than 0.03 mm, a strength of the winding is reduced and wire breakage is apt to occur in the winding step. When the wire diameter of the winding is over 1 mm, springback of the winding is too large and shape maintenance of the winding is difficult. Further, there is a possibility that forced shape maintenance leads to damage of the antenna magnetic core 1. A winding number of the winding is preferable to be 100 turns or more. A turn number of the winding is preferable to be in a range of 500 to 1500 turns, depending on a demanded magnetic property or size. It suffices that an insulation performance is secured between the antenna magnetic core 1 and the winding, and a winding method is not limited in particular. In the manufacturing step of the antenna of the embodiment, the following winding structure can be cited as a structure to improve a yield in the winding step.

Figure 5:
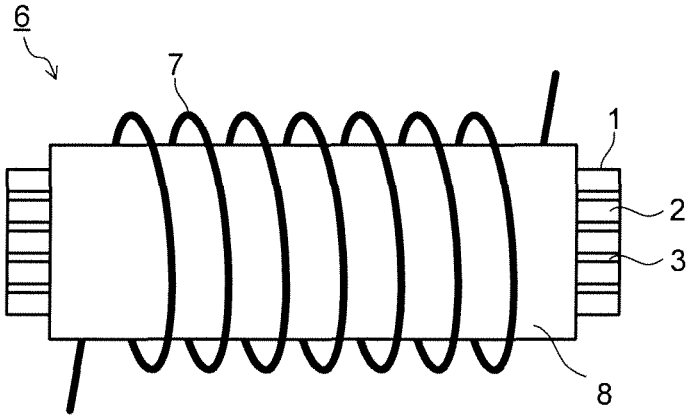
FIG. 5 is a view showing a first example of an antenna of the embodiment.

A first winding structure is a structure in which an insulating resin tape is attached to an antenna magnetic core 1 and a winding is applied on the insulating resin tape. FIG. 5 shows the first winding structure. In FIG. 5, a reference numeral 6 indicates an antenna, a reference numeral 7 indicates a winding, and a reference numeral 8 indicates an insulating resin tape. The insulating resin tape 8 is wound around an outer periphery of the antenna magnetic core 1. As the insulating resin tape 8, an insulating heat-resistant tape such as a Kapton adhesive tape is preferable. It is also effective to raise a strength by winding the insulating resin tape 8 twice or more as necessary. Winding the insulating resin tape 8 can improve an insulation performance and a strength. Therefore, it is possible to prevent destruction of the antenna magnetic core 1 in a winding step while the insulation performance of the winding 7 is maintained. Therefore, it is possible to improve a yield of the antenna 6.

Figure 6:
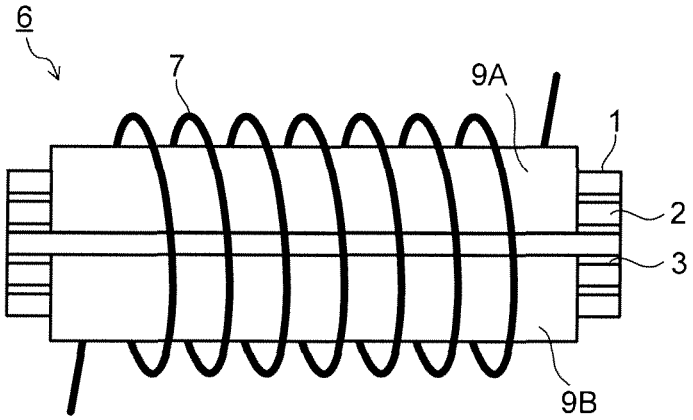
FIG. 6 is a view showing a second example of the antenna of the embodiment.

A second winding structure is a structure in which an antenna magnetic core 1 is put into an insulation case and a winding is applied onto the insulation case. FIG. 6 shows the second winding structure. In FIG. 6, a reference numeral 6 indicates an antenna, a reference numeral 7 indicates a winding, and reference numerals 9A, 9B indicates insulation cases. The insulation cases shown in FIG. 6 are the insulation cases 9A, 9B having U-shaped cross sections. The antenna magnetic core 1 is sandwiched by the insulation cases 9A, 9B having U-shaped cross sections from both sides and the winding 7 is wound from thereabove. Though FIG. 6 shows the insulation cases 9A, 9B having U-shaped cross sections, a shape of the insulation case is not limited. For example, a hollow insulation case can be used. The insulation case is preferable to be a molded body of a resin having a high insulation performance, such as a liquid crystal polymer. Since the winding is applied from above the insulation case 9, destruction of the antenna magnetic core 1 in the winding step can be prevented. Therefore, a yield of the antenna 6 can be improved.

Figure 7:
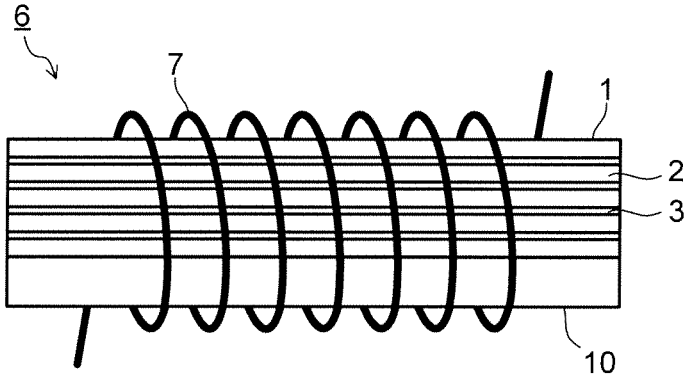
FIG. 7 is a view showing a third example of the antenna of the embodiment.

A third winding structure is a structure in which an insulating reinforcement member is laminated to an antenna magnetic core 1 and a winding is applied from thereabove. FIG. 7 shows the third winding structure. In FIG. 7, a reference numeral 6 indicates an antenna, a reference numeral 7 indicates a winding, and a reference numeral 10 indicates an insulating reinforcement member. The insulating reinforcement member 10 is an insulating member of a plate shape, and a resin plate is exemplified. The insulating reinforcement member 10 is preferable to be one whose shape is not changed even if a winding processing is performed. Since the antenna magnetic core 1 is disposed on the insulating reinforcement member 10 and the winding 7 is applied from thereabove, destruction of the antenna magnetic core 1 in the winding step can be prevented. Therefore, a yield of the antenna 6 can be improved. In a case of the third winding structure, since a part of the winding 7 contacts the antenna magnetic core 1, it is preferable to cover a surface of the antenna magnetic core 1 with an insulating resin.

The antenna 6 of the embodiment is suitably used for a detection system, for example. The detection system has a transmitter transmitting a specific radio signal, such as a radio signal whose content is a unique ID, and a receiver receiving the radio signal from the transmitter and detecting that the transmitter is a specific one. The antenna 6 is applicable to either a transmitting antenna of the transmitter or a receiving antenna of the receiver, but is suitable for the receiving antenna in particular. The receiver and the transmitter are constituted with card components, for example. The receiving antenna and the transmitting antenna are disposed in the card component, for example, and are resin-sealed with other components.

The antenna 6, being excellent in communication sensitivity in a frequency band of 40 to 150 kHz, is suitable for a detection system using a radio signal whose frequency is in a range of 40 to 150 kHz. The antenna 6 exhibits a good communication property in a frequency band of 120 to 130 kHz. Further, the antenna magnetic core 1 constituting the antenna 6 does not have fragility as a ferrite magnet core has or easy rusting as a magnetic core using a Fe-based amorphous magnetic alloy thin strip has. The antenna 6 is suitable for a detection system used in a usage environment in which a stress is applied or in a usage environment which is high in humidity. Note that the antenna 6 is applicable not only to the receiving antenna of the receiver in the detection system but also to a receiving antenna of a radio controlled watch, particularly a receiving antenna of a radio controlled wristwatch which is demanded to be downsized, for example.

As a concrete example of the detection system of the embodiment, there can be cited a vehicle detection system such as an automobile detection system, an RFID tag system used for management of various articles or entrance/exit management, and so on. As the automobile detection system, there can be cited an automobile keyless entry system (or called a smart entry system). The keyless entry system is a system in which a receiver is mounted on a handle, a tire, a door, or the like and ON/OFF of a switch is performed by a portable transmitter. Thereby, ON/OFF of locking of the handle, locking of the tire, locking of the door, and the like can be performed without inserting a key into a cylinder. When mounted on the tire, the detection system can be also used as a detection system of a tire pressure monitoring system (TPMS).

Since a metal body is used in an automobile, the metal body inhibits communication when a frequency of a radio signal becomes high. Thus, a signal of a comparatively low frequency band of about 40 to 150 kHz is used. The antenna 6 of the embodiment, being excellent in a communication property of a frequency band of 40 to 150 kHz, particularly a frequency band of 120 to 130 kHz, is suitable for a detection system in which a radio signal of that frequency band is used. Note that usage in an automobile is described as a keyless entry system, but other than the above, the antenna 6 of the embodiment can be applied also to a keyless entry system for a vehicle such as a motorbike or a bicycle, in which a signal of that frequency band is used. Further, the antenna 6 of the embodiment is applicable to a detection system for security such as open/close management of a door of a building or anti-crime security.

In applying the antenna 6 of the embodiment to a detection system, the antenna 6 is attached to a card, a casing, or the like of the detection system. When attached to the detection system, the antenna 6 is preferable to be fixed with an adhesive having a percentage of water absorption of 1% or less. When the percentage of water absorption of the adhesive fixing antenna 6 is over 1%, the adhesive with which the antenna 6 is attached absorbs water when the antenna 6 is used as the detection system, so that a problem occurs such that the adhesive is swollen to apply an unnecessary stress to the antenna 6 or that an attachment position is displaced. For example, an antenna of a receiver of a keyless entry system, a radio controlled watch, or the like is embedded in a small space. If the adhesive generates a problem such as occurrence of an unnecessary stress or displacement due to absorption of water, a performance of the detection system is reduced. Therefore, it is preferable to use an adhesive with a percentage of water absorption of 1% or less for fixing the antenna 6.

EXAMPLES

Next, concrete examples and evaluation results thereof will be described.

Example 1

There is prepared a Co-based amorphous magnetic alloy thin strip (composition (atomic ratio): $Co_{80.95}Fe_{3.95}Nb_{2.8}Cr_{2.0}Si_{7.9}B_{2.4}$) with a plate thickness of 20 μm by a weighing method. The Co-based amorphous magnetic alloy thin strip is slit into 3.5 mm and a semi-cured epoxy resin layers are applied to be 3 μm in thickness on both surfaces thereof. The Co-based amorphous magnetic alloy thin strip is cut-processed to have a length of 13 mm, so that a Co-based amorphous magnetic alloy thin strip provided with strip-like resin layers with long edges of 13 mm and short edges of 3.5 mm is prepared. Sixteen Co-based amorphous magnetic alloy thin strips provided with resin layers on both surfaces are laminated and cure-processed (120° C.×30 minutes), to cure the resin layers.

Examples 2 to 5

Antenna magnetic cores are fabricated similarly to in the example 1, except that sizes, lamination numbers, thicknesses of resin layer parts, and the like of Co-based amorphous magnetic alloy thin strips are changed as shown in Table 1.

Comparative Example 1

A laminate made by laminating sixteen Co-based amorphous magnetic alloy thin strips with long edges of 13 mm and short edges of 3.5 mm is immersed in an epoxy resin liquid, to fabricate an antenna magnetic core of a comparative example 1.

Comparative Example 2

A long-length Co-based amorphous magnetic alloy thin strip with short edges of 3.5 mm is wound around a reel. Four such reels are prepared, and the long-length Co-based amorphous magnetic alloy thin strips, after a step of being immersed in an epoxy resin liquid, are laminated to form laminates. Next, after being cut-processed so that a long edge becomes 12 mm, four laminates are stacked so that the lamination number of the Co-based amorphous magnetic alloy thin strips becomes 16 in total. In this way, an antenna magnetic core of a comparative example 2 is fabricated.

For the antenna magnetic cores of the examples and the comparative examples, arbitrary cross sections are observed, and existence/absence of gaps in the resin layer parts, average thicknesses and dispersion of thicknesses of the resin layer parts are investigated. Projecting part sizes in the cross sections are also investigated. Appearance yields are investigated. The appearance yield is a ratio of products in which a defect such as a protrusion of a resin is not found by visual observation and which is judged to be a good product. Results thereof are shown in Table 1.

TABLE 1

| | Magnetic alloy thin strip | | Resin layer part | | | Size of | |
|---|---|---|---|---|---|---|---|
| | Size (long edge × short edge × thickness) | Lamination number | Average thickness [μm] | Dispersion of thicknesses [%] | Existence/ absence of gap | projecting part [μm] | Appearance yield [%] |
| E1 | 13 mm × 3.5 mm × 20 μm | 16 | 6 | ±25 | absent | 0.2 | 100 |
| E2 | 12 mm × 4 mm × 18 μm | 20 | 5 | ±35 | absent | 0.2 | 97 |
| E3 | 15 mm × 4 mm × 18 μm | 20 | 4 | ±20 | absent | 0.2 | 98 |
| E4 | 12.2 mm × 4.5 mm × 20 μm | 20 | 4 | ±16 | absent | 0.2 | 99 |
| E5 | 12 mm × 4.5 mm × 20 μm | 20 | 5 | ±10 | absent | 0.2 | 99 |
| CE1 | 13 mm × 3.5 mm × 20 μm | 16 | 3 | ±50 | absent | 2.3 | 82 |
| CE2 | 13 mm × 3.5 mm × 20 μm | 16 | 4 | ±60 | absent | 0.5 | 85 |

E1 to E5: Example 1 to 5; CE1 to CE2: Comparative Example 1 to 2

As is known from the table, the thickness of the resin layer part of the antenna magnetic core of the example can be made uniform. In the antenna magnetic core of the example, since a semi-cured resin is applied to both surfaces on the amorphous magnetic alloy thin strip before lamination and solidification of the semi-cured resin is performed after lamination thereof, a problem such as coating irregularity or running down of the resin does not occur, so that the thicknesses of the resin layer part can be made uniform. In contrast, since an emersion method is used in the comparative example 1 and the comparative example 2, dispersion of thicknesses of the resin layer part is large. In a method in which a laminate of Co-based amorphous magnetic alloy thin strips is resin-impregnated as in the comparative example 1, a resin layer does not enter the inside of the laminate, to form a gap part in which a resin layer is not formed. Further, in a case where cutting and laminating are performed before a resin layer part is formed as in the comparative example 1, a size of a projecting part is large.

Examples 6 to 10

There is prepared a Co-based amorphous magnetic alloy thin strip (composition (atomic ratio): $Co_{81.00}Fe_{3.80}Nb_{2.7}Cr_{2.2}Si_{7.9}B_{2.4}$) with a plate thickness of 18 μm by a weighing method. The Co-based amorphous alloy thin strip is slit and semi-cured epoxy resin layers are applied on both surfaces thereof. Sizes (long edge×short edge) of the Co-based amorphous magnetic alloy thin strips after being slit, lamination numbers, average thicknesses of resin layer parts are as shown in Table 2. Heat treatments for curing (solidification) are performed under conditions shown in Table 2.

TABLE 2

| | Magnetic alloy thin strip | | | |
|---|---|---|---|---|
| | Size (long edge × short edge) [mm] | Lamination number | Average thickness of resin layer part [μm] | Curing treatment |
| Example 6 | 12 × 3 | 20 | 3 | 150° C. × 30 minutes |
| Example 7 | 13 × 4 | 16 | 2 | 180° C. × 20 minutes |
| Example 8 | 14 × 4 | 18 | 4 | 200° C. × 15 minutes |
| Example 9 | 16 × 5 | 20 | 4 | 210° C. × 10 minutes |
| Example 10 | 14 × 4.5 | 22 | 3 | 220° C. × 20 minutes |

For obtained antenna magnetic cores, dispersion of thicknesseminus of the resin layer parts, existence/absence of gaps in the resin layer parts, sizes of the projecting parts, and appearance yields are investigated. Results thereof are shown in Table 3.

TABLE 3

| | Resin layer part | | | |
|---|---|---|---|---|
| | Dispersion of thicknesses [%] | Existence/absence of gap | Size of projecting part [μm] | Appearance yield [%] |
| Example 6 | ±15 | absent | 0.2 | 99 |
| Example 7 | ±20 | absent | 0.2 | 99 |
| Example 8 | ±10 | absent | 0.2 | 99 |
| Example 9 | ±10 | absent | 0.2 | 99 |
| Example 10 | ±15 | absent | 0.2 | 99 |

As is known from the table, the thicknesses of the resin layer part of the antenna magnetic core of the example can be made uniform. In the antenna magnetic core of the example, since a semi-cured resin is applied to both surfaces on a Co-based amorphous magnetic alloy thin strip before lamination and solidification of the semi-cured resin is performed after lamination thereof, a problem such as coating irregularity or running down of the resin does not occur, so that the thicknesses of the resin layer part are made uniform. Since a heat treatment temperature for curing the resin layer part is as high as 150 to 220° C., a heat treatment time can be made short.

Examples 1A to 10A, Comparative Examples 1A to 2A

Antennas are fabricated by using antenna magnetic cores of the examples 1 to 10 and the comparative examples 1 to 2. In fabricating the antenna, a polyimide tape is wound around the antenna magnetic core for reinforcement. A winding (having an insulation coating on a surface) with a wire diameter of 0.05 mm is applied for 580 turns from above the polyimide tape, to form the antenna. For each antenna, an L value and a Q value are measured. A measurement condition of the L value and the Q value is 134.2 kHz, 1.0 V. Results thereof are shown in Table 4.

TABLE 4

| | Antenna magnetic core | L value [mH] | Q value |
|---|---|---|---|
| Example 1A | Example 1 | 3.75 | 35.0 |
| Example 2A | Example 2 | 3.76 | 28.2 |
| Example 3A | Example 3 | 4.88 | 28.5 |
| Example 4A | Example 4 | 4.05 | 30.0 |
| Example 5A | Example 5 | 4.78 | 33.0 |
| Comparative Example 1A | Comparative Example 1 | 3.65 | 25.5 |
| Comparative Example 2A | Comparative Example 2 | 3.70 | 27.1 |
| Example 6A | Example 1 | 3.71 | 33.0 |
| Example 7A | Example 1 | 3.72 | 35.0 |
| Example 8A | Example 1 | 4.02 | 34.5 |
| Example 9A | Example 1 | 4.95 | 33.5 |
| Example 10A | Example 1 | 4.90 | 33.0 |

As is known from the table, the antenna of the example is excellent in the L value and the Q value. The comparative examples 1 and 2 are good products in appearance but have low L values and Q values. When examples are compared, it is found that the antenna magnetic cores of the examples 6 to 10 whose curing heat treatment temperature is 150 to 220° C. are comparatively improved in the Q values than the antenna magnetic cores of the examples 1 to 5 whose curing heat treatment temperature is 120° C. This is because a curing heat treatment grants a heat treatment effect for improving a magnetic property as a result that the heat treatment temperature is set in a range of 150 to 220° C.

Examples 11 to 18

The antenna magnetic cores of the example 1 are prepared. Next, polyimide tapes are wound and windings are applied from thereabove, to make examples 11 to 12. The antenna magnetic cores are housed in insulation cases (15×5.5×1.0 mm) and windings are applied from thereabove, to make examples 13 to 14. The antenna magnetic cores are disposed on reinforcing plates (13×3.5×0.1 mm) and windings are applied, to make examples 15 to 16. Windings are applied without using any one of a polyimide tape, an insulation case, and a reinforcing plate, to make examples 17 to 18. A hundred antennas are fabricated per each example, and yields thereof are investigated. Results thereof are shown in Table 5.

TABLE 5

| | | Winding processing | | |
|---|---|---|---|---|
| | Reinforcing member | Wire diameter [mm] | Number of turns | Yield [%] |
| Example 11 | Polyimide tape | 0.05 | 580 | 95 |
| Example 12 | Polyimide tape | 0.05 | 780 | 91 |
| Example 13 | Insulation case | 0.05 | 580 | 100 |
| Example 14 | Insulation case | 0.05 | 780 | 98 |
| Example 15 | Reinforcing plate | 0.05 | 580 | 99 |
| Example 16 | Reinforcing plate | 0.05 | 780 | 97 |
| Example 17 | (none) | 0.05 | 580 | 85 |
| Example 18 | (none) | 0.05 | 780 | 83 |

As is known from the table, the yield can be improved substantially by using the reinforcing member. Further, since the yield as the antenna magnetic core is good as described above, the yield as the antenna can be improved substantially.

Example 19 to 21

Antennas (antennas made by applying winding processings of 580 turns are applied to the antenna magnetic cores of the example 8) of the example 8A are prepared. Next, the antennas are adhered to casings with adhesives, as antennas of receivers of keyless entry systems (detection systems). On this occasion, the adhesives having percentages of water absorption shown in Table 6 are used. Durability tests of the antennas adhered to respective receivers are performed. The durability tests are performed, while the antennas being kept under an environment of a temperature of 85° C. and a humidity of 85% for 1000 hours, by measuring existence/absence of displacement and degrees of reduction of the Q values thereafter. Results thereof are shown in Table 6.

TABLE 6

| | | Durability test | |
|---|---|---|---|
| | Percentage of water absorption of adhesive [%] | Existence/absence of displacement | Q value |
| Example 19 | 0.4 | absent | 32.0 |
| Example 20 | 1.0 | absent | 27.2 |
| Example 21 | 3.5 | exists | 25.5 |

As is known from the table, by using the adhesive with the percentage of water absorption of 1% or less for fixing the antenna, durability of a joining part is improved substantially. Thus, it is possible to improve long-time reliability of the antenna with a good property according to the example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna magnetic core, comprising a laminate including ten or more of Co-based amorphous magnetic alloy thin strips which are laminated and each has an average thickness in a range of from 10 to 30 μm, and resin layer parts which are respectively provided between the laminated Co-based amorphous magnetic alloy thin strips and each has an average thickness in a range of from 1 to 10 μm, wherein each of the resin layer parts is made of a solid body of a semi-cured resin;

a dispersion of thicknesses of each of the resin layer parts is within ±40% in relation to the average thickness; and each of the resin layer parts does not have a gap therein.

2. The antenna magnetic core according to claim 1, wherein the Co-based amorphous magnetic alloy thin strip has a rectangular shape satisfying at least one of a short edge being 1 mm or more and a long edge being 10 mm or more.

3. The antenna magnetic core according to claim 1, wherein a cutting processing is applied to at least one outer edge of the Co-based amorphous magnetic alloy thin strip.

4. The antenna magnetic core according to claim 3, wherein a height of a projecting portion generated in the outer edge to which the cutting processing is applied is 2 μm or less.

5. The antenna magnetic core according to claim 1, wherein the dispersion of the thicknesses of the resin layer part is within ±30% in relation to the average thickness.

6. The antenna magnetic core according to claim 1, wherein the resin layer part is made of an epoxy-based resin or a urethane-based resin.

7. An antenna, comprising:

an antenna magnetic core according to claim 1; and a winding wound around an outer periphery of the antenna magnetic core.

8. The antenna according to claim 7, wherein the winding is wound around the outer periphery of the antenna magnetic core via at least one selected from an insulating resin tape, an insulation case, and an insulating reinforcement member.

9. The antenna according to claim 7, wherein a winding number of the winding is 100 turns or more.

10. A detection system, comprising:

a transmitter transmitting a specific radio signal; and a receiver receiving the radio signal to detect the transmitter, wherein the receiver comprises an antenna according to claim 7 as a receiving antenna of the radio signal.

11. The detection system according to claim 10, wherein the antenna is fixed with an adhesive whose percentage of water absorption is 1% or less.

12. The detection system according to claim 10, wherein a frequency of the radio signal is in a range of from 40 to 150 kHz.

13. The detection system according to claim 10, being a vehicle keyless entry system.

* * * * *